US012448845B1

(12) United States Patent
Rogers

(10) Patent No.: US 12,448,845 B1
(45) Date of Patent: Oct. 21, 2025

(54) APPARATUS WITH FLUID POWERED DRIVE ASSEMBLIES AND METHOD OF FABRICATION

(71) Applicant: Legend Design and Consulting, LLC, Owasso, OK (US)

(72) Inventor: Henry Eugene Rogers, Owasso, OK (US)

( * ) Notice: Subject to any disclaimer, the term of this patent is extended or adjusted under 35 U.S.C. 154(b) by 0 days.

(21) Appl. No.: 19/037,176

(22) Filed: Jan. 25, 2025

(51) Int. Cl.
*E21B 4/02* (2006.01)
*E21B 4/00* (2006.01)

(52) U.S. Cl.
CPC ..... *E21B 4/02* (2013.01); *E21B 4/003* (2013.01)

(58) Field of Classification Search
CPC ..... E21B 4/02; E21B 4/003
See application file for complete search history.

(56) References Cited

U.S. PATENT DOCUMENTS 10,968,701 B2 4/2021 Phillips
2012/0201659 A1* 8/2012 Savage ..... F04D 13/10 415/143
2021/0285289 A1* 9/2021 Wang ..... E21B 4/006
2024/0183223 A1 6/2024 Phillips et al.

FOREIGN PATENT DOCUMENTS

GB 2609885 B 2/2023

* cited by examiner

*Primary Examiner* — Dany E Akakpo
(74) *Attorney, Agent, or Firm* — Avek IP, LLC

(57) ABSTRACT

A downhole apparatus with fluid powered drive assemblies for driving a cutting structure. The apparatus includes a power assembly body to couple to a casing string and the cutting structure, the body forming a central flow bore and fluid conduits disposed between an outer wall and an inner wall, each conduit having an inlet and outlet. A lower drive body couples the power assembly body to the cutting structure. Each of the fluid powered drive assemblies includes a stator profile forming a stator bore within the associated fluid conduit; a rotor extending within the stator bore; a rotor drive gear coupled to the rotor; and a lower drive body gear to receive torque from the rotor drive gear. Fluid flow through generates power transmission to the rotor drive gear to transfer torque to the lower drive body gear and then to the lower drive body to operate the cutting structure.

16 Claims, 10 Drawing Sheets

APPARATUS WITH FLUID POWERED DRIVE ASSEMBLIES AND METHOD OF FABRICATION

FIELD OF THE DISCLOSURE

The disclosure relates generally to tools for use in well operations. More specifically, the disclosure relates to an apparatus with fluid powered drive assemblies and a method of fabricating the same, the apparatus configured to convert fluid power to mechanical rotation at a distal end of a tubular string for purposes of cutting or boring through formation.

BRIEF SUMMARY OF INVENTION

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere.

In some aspects, the present invention relates to a downhole apparatus with a plurality of fluid powered drive assemblies for driving a cutting structure. The apparatus includes a power assembly body configured to couple to a casing string and to the cutting structure, the power assembly body forming a central flow bore and having an outer wall and an inner wall forming a plurality of fluid conduits disposed therebetween, each of the fluid conduits having a fluid inlet and a fluid outlet. The apparatus further includes a lower drive body coupling the power assembly body to the cutting structure; and the plurality of fluid powered drive assemblies configured to transmit torque to the lower drive body, each of the plurality of fluid powered drive assemblies independently associated with each of the plurality of fluid conduits. Each of the plurality of fluid powered drive assemblies includes a stator profile forming a stator bore within the associated fluid conduit; a rotor extending within the stator bore; a rotor drive gear coupled to the rotor; and a lower drive body gear configured to receive torque from the rotor drive gear. The fluid flow through the associated fluid conduit generates power transmission to the rotor drive gear which then transfers torque to the lower drive body gear which then transfers torque to the lower drive body to operate the cutting structure.

In other aspects, the present invention relates to a method of fabricating a downhole apparatus with a plurality of fluid powered drive assemblies. The method includes fabricating a power assembly body with an outer wall and an inner wall forming a plurality of fluid conduits disposed therebetween, the power assembly body fabricated with a central flow bore. Further, fabricating a lower drive body configured to couple the power assembly body with a cutting structure such that torque is transmitted to the cutting structure. And, embedding the plurality of fluid powered drive assemblies into the plurality of fluid conduits, the plurality of fluid powered drive assemblies configured to transmit torque to the lower drive body. Each of the plurality of fluid powered drive assemblies includes a stator profile forming a stator bore within the associated fluid conduit; a rotor extending within the stator bore; a rotor drive gear coupled to the rotor; and a lower drive body gear configured to receive torque from the rotor drive gear. Then, coupling the lower drive body to the power assembly body via the plurality of fluid powered drive assemblies. The downhole apparatus, once fabricated, is configured such that fluid flow through the associated fluid conduit generates power transmission to the rotor drive gear which then transfers torque to the lower drive body gear which then transfers torque to the lower drive body to operate the cutting structure.

BRIEF DESCRIPTION OF THE SEVERAL VIEWS OF THE DRAWINGS

Illustrative embodiments of the present disclosure are described in detail below with reference to the attached drawing figures.

LIST OF REFERENCE NUMBERS

Figure 1:
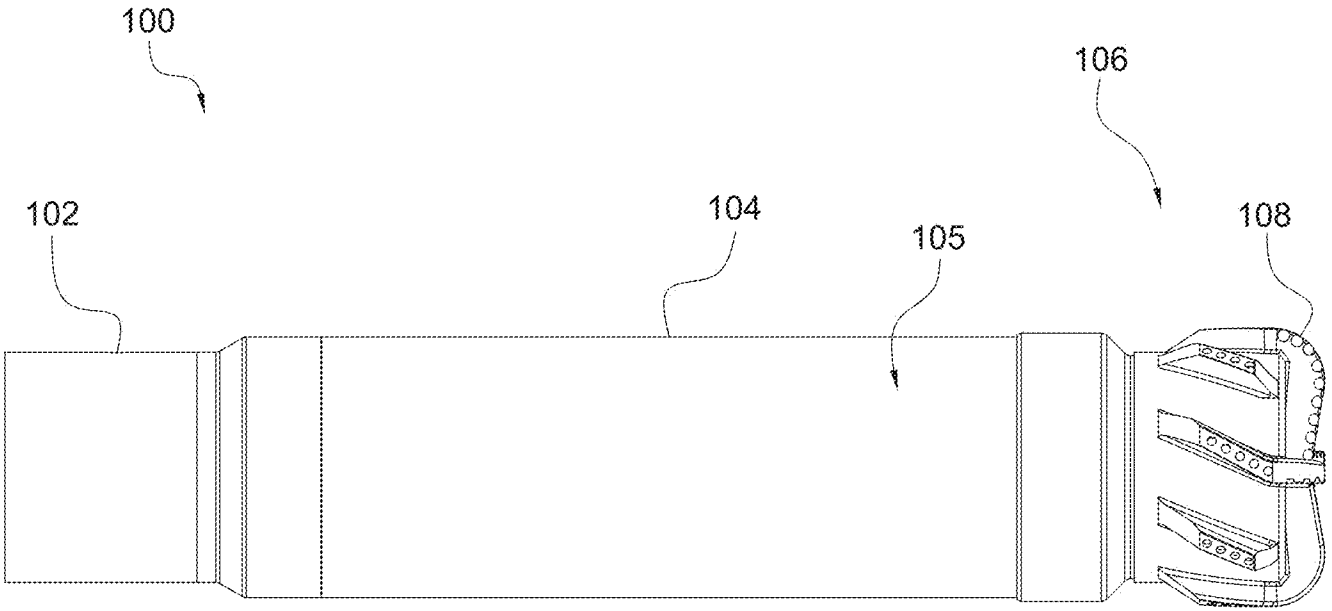
FIG. 1 is a side view of an apparatus with fluid powered drive assemblies in accordance with the present invention.

100—Apparatus
102—Upper Body
104—Power Assembly Body
105—Smooth Outer Surface
106—Nose
108—Cutting Structure
200—Central Flow Bore
202—Central Flow Barrier
204—Upper Flow Port(s)
204(*a*)—Fluid Inlet
206—Lower Flow Port(s)
206(*a*)—Fluid Outlet
208—Upper Nut
210—Lower Drive Assembly
300—Outer Wall
302—Inner Wall
304—Fluid Conduit
306*a*—e-Flow Path
308—Burst Disk
310—Stator Bore
312—Rotor
314—Lower Drive Body
400—Stator Profile
402—Rotor End
404—Lower Drive Body Gear
406—Rotor Drive Gear

408—Rotor Drive Gear Thrust Bearing
410—Split Retainer Ring
412—Recess into Power Assembly Body 104
414—Ring Retainer
416—Thrust Bearing Arrangement
500—Lower End of the Power Assembly Body 104
600—Lower Drive Body Gear Lug
1000—Portion of Lower Drive Body The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of the equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Well drilling operations are well known in the art, particularly in the oil and gas industry. This complex industry utilizes a plurality of tools and assemblies in preparing a well for extraction of oil and/or gas from the formation surrounding the well. In order to extract oil and/or gas from a formation, a borehole must be drilled into the formation. Although there are several methods that can be utilized to drill said borehole, one conventional method is to attach a cutting apparatus having a drill bit directly to casing string, wherein torque is then applied from the surface to the apparatus such that the drill bit can bore into the formation. This conventional method is limited, specifically this method cannot always provide adequate torque transference from the surface to a desired depth. In addition, these conventional methods are of limited efficiency in horizontal drilling.

Accordingly, the present invention provides for an apparatus with fluid powered drive assemblies, wherein the apparatus is configured to connect to the casing string. The apparatus includes a power assembly body having an appropriate thickness between an outer wall and an inner wall such that a plurality of fluid conduits are formed therebetween. The apparatus further includes a plurality of fluid powered drive assemblies, wherein each of the fluid powered drive assemblies is configured to transfer torque generated from fluid flow through the plurality of fluid conduits to a nose incorporating the cutting structure. Accordingly, the transferred torque allows for the cutting structure to bore or cut through the formation. By incorporating the fluid powered drive assemblies into the power assembly body of the apparatus, the system provides for greater output power or torque compared to conventional power systems.

FIG. 1 depicts a side view of the apparatus 100 with fluid powered drive assemblies. The apparatus 100 may include an upper body 102 configured to connect to the casing string (not shown), the upper body 102 then coupled to the power assembly body 104 having a smooth outer surface 105. The power assembly body 104 also coupling to a nose 106 having a cutting structure 108 as part thereof. Those skilled in the art will appreciate that the cutting structure 108 may vary in design and features as could be applicable for various uses of the apparatus 100. The smooth outer surface 105 extends at least a majority of the power assembly body 104, and in embodiments extends the full length of the body 104. The smooth outer surface 105 specifically lacking radially projecting blades or other elements. Fabricating the power assembly body 104 with a smooth outer surface 105 provides for improved strength of the body 104 and less machining during fabrication. In addition, fabricating a body with a smooth outer surface is easier than one with any radially protruding structures, and helps ensure that the body can handle maximum annular velocity of wellbore fluid.

Figure 2:
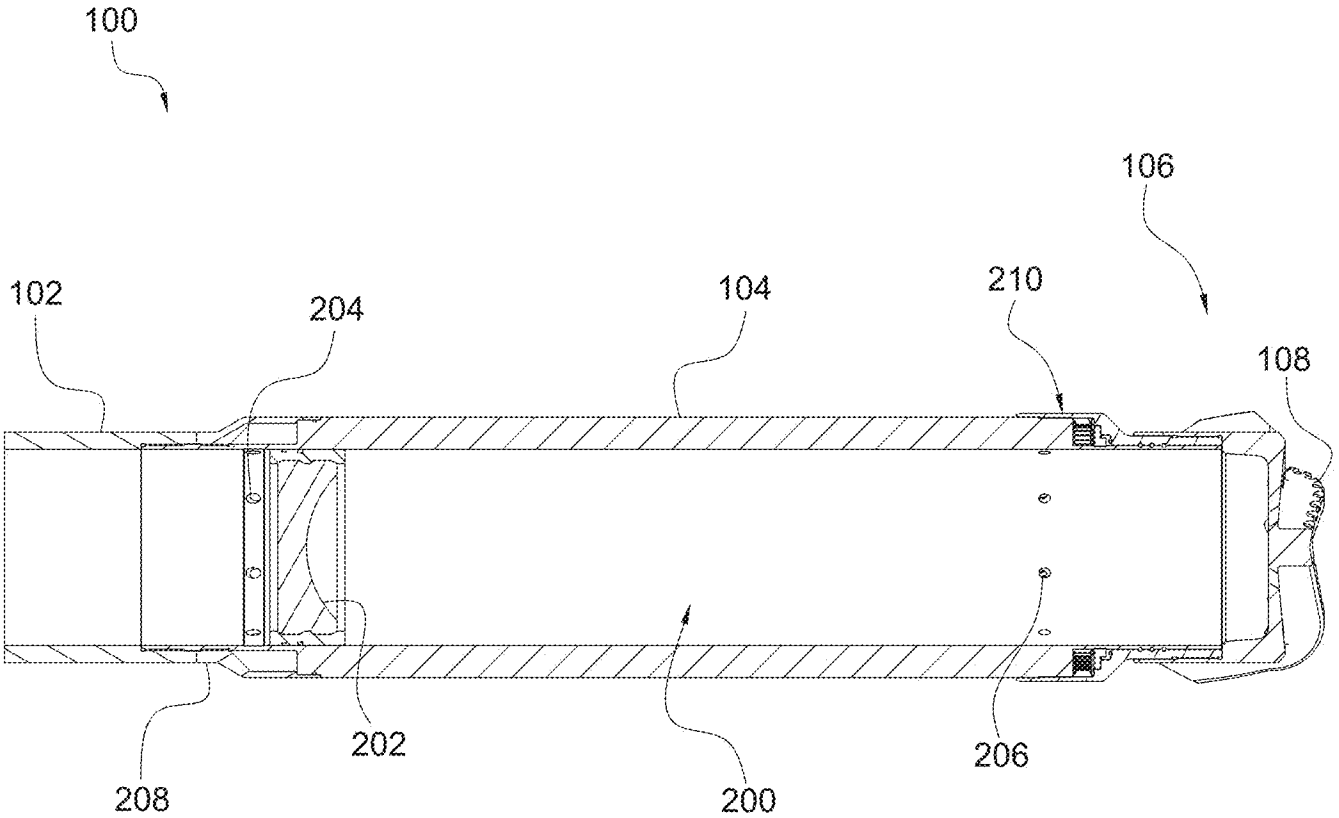
FIG. 2 is a side, cross-sectional view of the apparatus of FIG. 1.

FIG. 2 depicts a first cross-sectional view of the apparatus 100. The power assembly body 104 forms a central bore 200. In embodiments, a central flow barrier 202 is mounted within the central flow bore 200 and configured to block fluid flow therethrough. The use of the barrier 202 directs fluid flow through upper flow port(s) 204 into the power assembly body 104 and out of lower flow port(s) 206. Those skilled in the art will appreciate that central flow barrier 202 may vary based on functional considerations applicable to the use of the apparatus 100. In embodiments, the upper body 102 couples the power assembly body 104 to the casing string (not shown). An upper nut 208 is further coupled to the power assembly body to provide the upper flow port(s) 204 into a plurality of conduits 304.

As discussed, the present invention provides for a plurality fluid powered drive assemblies 210 configured to convert fluid power to force applied to the nose 106. This is shown and discussed in more detail in FIGS. 3 and 4.

Figure 3:
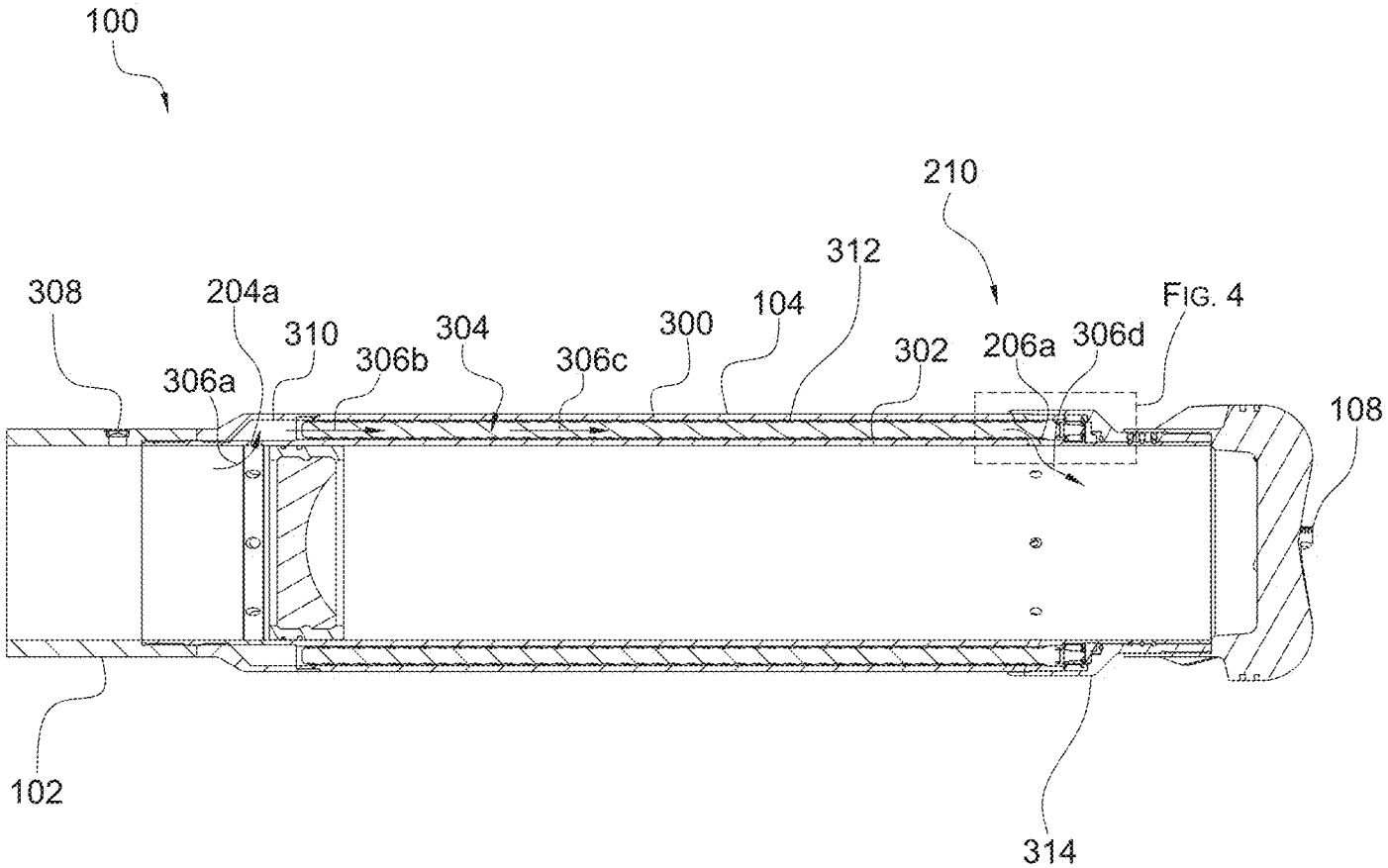
FIG. 3 is another side, cross-sectional view of the apparatus of FIG. 1, rotated 23 degrees in comparison to the view of FIG. 2.

Specifically, FIG. 3 depicts apparatus 100 rotated 23 degrees from shown in FIG. 2. Here, an outer wall 300 and an inner wall 302 of the power assembly body 104 are shown, wherein a fluid conduit 304 is created between the outer and inner walls 300, 302. In embodiments, a thickness between the outer and inner walls 300, 302 is consistent and forms a plurality of fluid conduits, though the details of only one conduit 304 are shown and discussed herein. Those skilled in the art will appreciate that the fluid conduits and fluid powered drive assemblies can vary in number and the teachings discussed with one can be applied to the others. Also shown in FIG. 3, is a burst disk 308 positioned within the upper body 102. The burst disk 308 allows for a fluid flow path from the central flow bore 200 to the annulus in the event the fluid conduits 304 become plugged or blocked from flow because of wellbore debris. It is contemplated that in alternative embodiments, the burst disk 308 can be located in the central flow barrier 202.

The fluid conduit 304 is in fluid communication with casing string above the apparatus 100 via a fluid inlet 204(*a*) as part of the upper nut 208 and further is in fluid communication with the annulus via a fluid outlet 206(*a*). In other words, drive fluid (such as drilling mud or other drilling fluid), follows the flow path shown with arrows 306*a*, 306*b*, 306*c*, 306*d*, 306*e*, wherein the fluid provides power for the fluid powered drive assembly 210 to generate torque for transmission to the nose 106, ultimately causing rotation of the cutting structure 108 for formation digging and boring.

Figure 4:
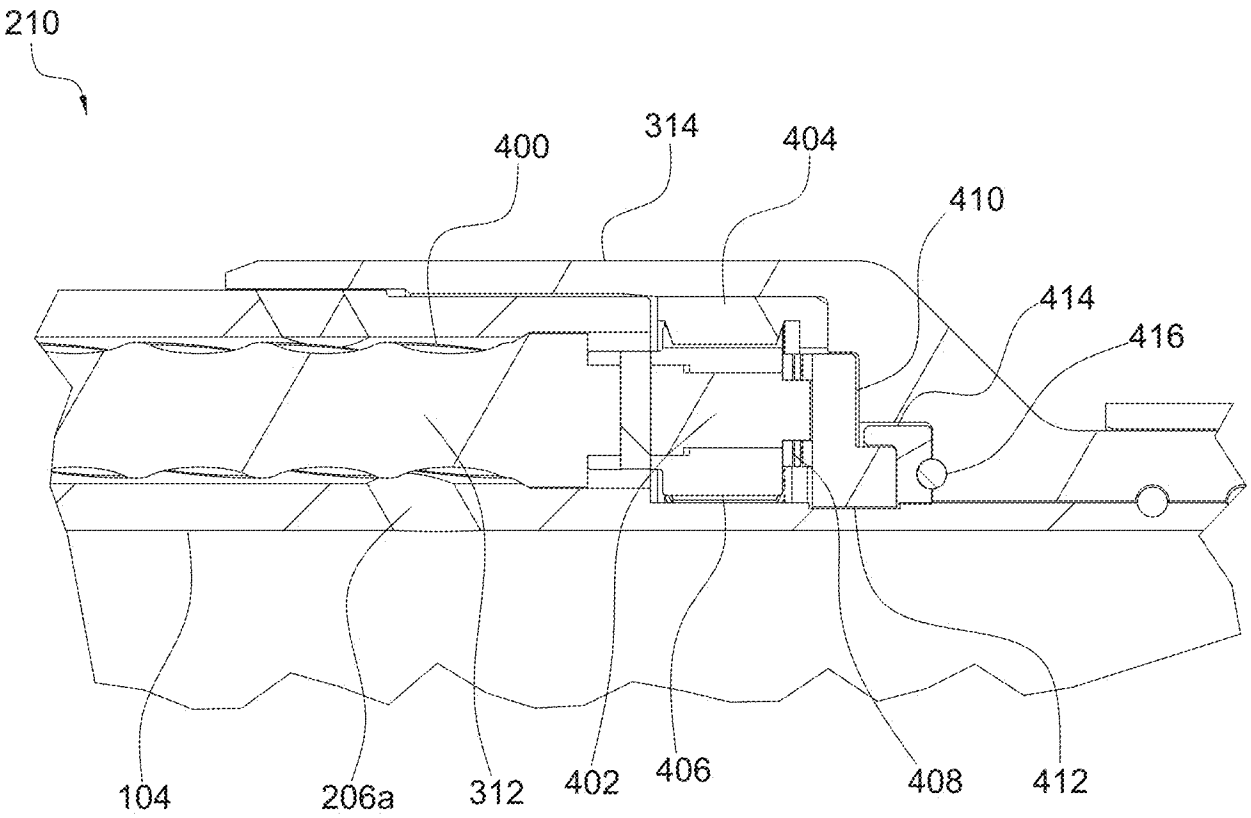
FIG. 4 is a detailed side view of a section of the apparatus of FIG. 1 as labeled in FIG. 3.

The drive assembly 210, in embodiments, comprises a stator and rotor assembly, wherein a stator bore 310 is created and positioned within the fluid conduit 304. A rotor 312 extends within the stator bore 310 and is configured to rotate therein such that torque is ultimately transferred to a lower drive body 314. This is best shown in FIG. 4, which demonstrates the rotor 312 surrounded by a stator profile 400 which may be separate or integral with the power assembly body 104. A lower end 402 of the rotor 312 transfers torque to the lower drive body 314 via a gear assembly. Specifically, a lower drive body gear 404 is coupled to the lower drive body 314. The lower drive body gear 404, in embodiments, may be integral with the lower drive body 314. This gear 404 engages with a rotor drive gear 406 such that as the rotor 312 rotates, torque transfers from the rotor drive gear 406 to the lower drive body gear 404. Those skilled in the art will appreciate that the lower drive body gear 404 is positioned radially outward from the rotor drive gear 406. This provides for improved torque transference to the lower drive body 314.

Continuing with FIG. 4, the drive assembly 210 also includes a rotor drive gear thrust bearing 408 positioned in line with the rotor 312 and abutting the end 402 of the rotor 312. Those skilled in the art will appreciate that the rotor drive gear thrust bearing 408 supports axial stress while allowing rotary motion. Also shown is a split retainer ring 410 positioned to retain the rotor 312 in place. Split Retainer ring 410 extends partially into a recess 412 of the power assembly body 104. Specifically, in embodiments, the recess 412 extends radially inward and is configured to support the split retainer ring 410 that projects radially outward and abuts the rotor drive gear thrust bearing 108. Further, a ring retainer 414 nests with split retainer ring 410 and also aids in retaining the split retainer ring 410 in the desired location. Finally, a thrust bearing arrangement 416 nests between the ring retainer 414 and the lower drive body 314, the thrust bearing arrangement 416 comprising a plurality of bearings, allowing for rotation of the lower drive body 314 relative to the power assembly body 104.

Figure 5:
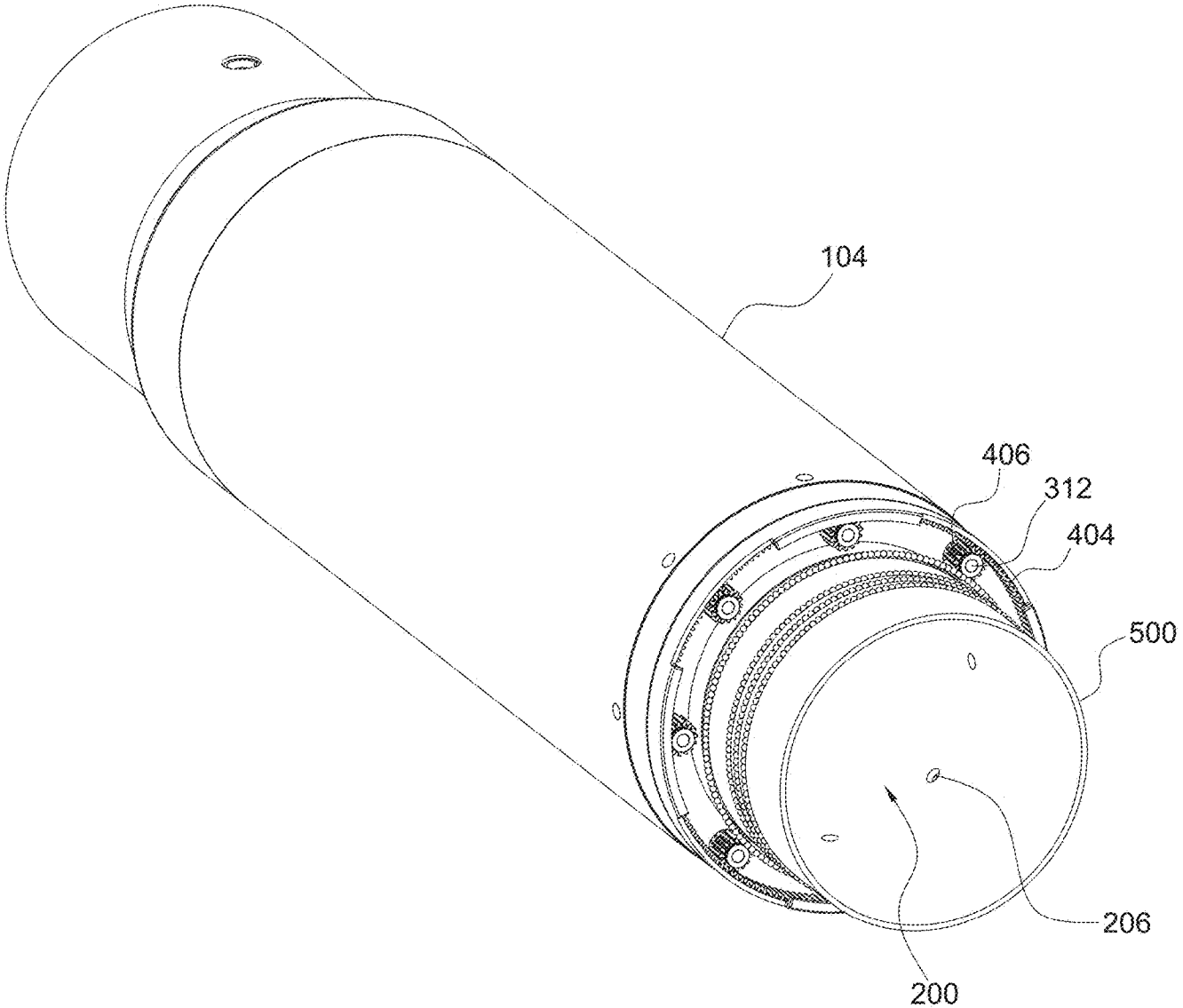
FIG. 5 is a perspective end view of a lower drive assembly as part of the apparatus of FIG. 1.
Figure 6:
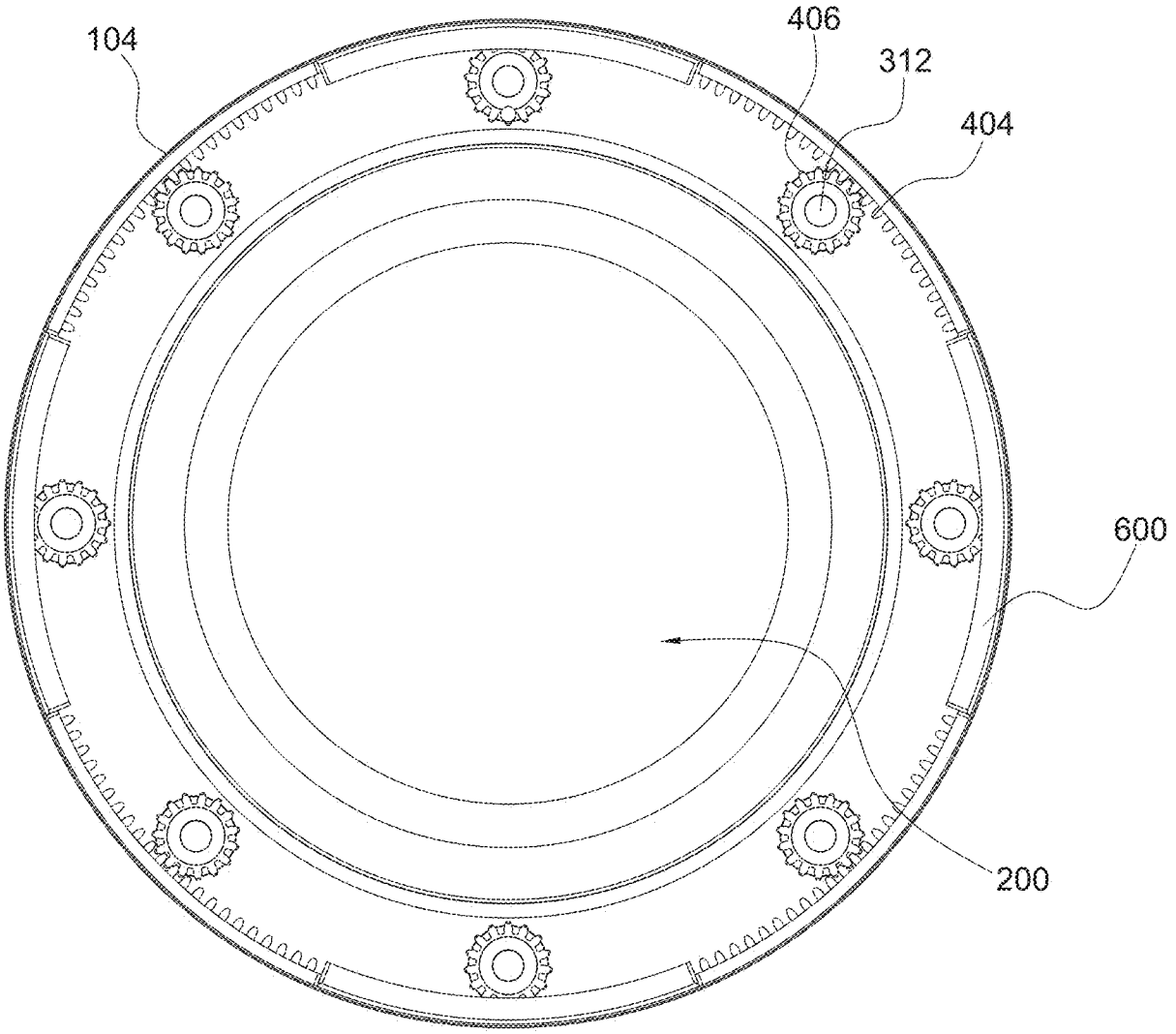
FIG. 6 is an end view of the lower drive assembly as part of the apparatus of FIG. 1.
Figure 7:
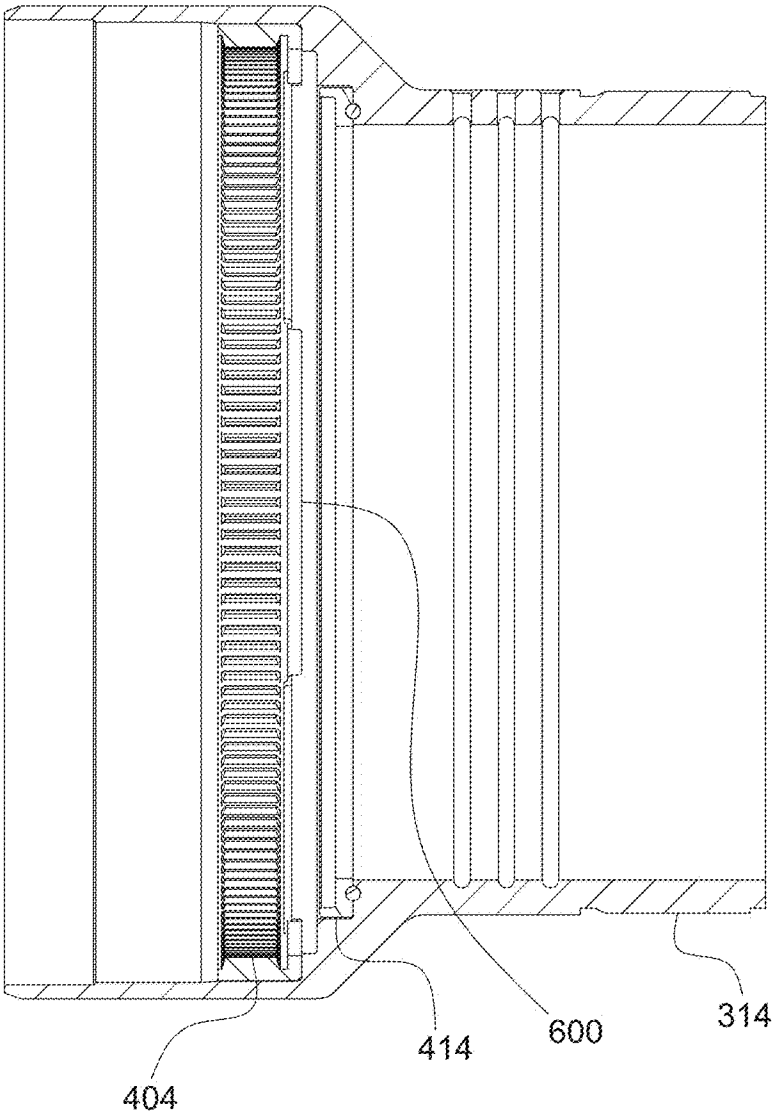
FIG. 7 a side, cross-sectional view of a lower drive body and a lower drive body gear as part of the apparatus of FIG. 1.
Figure 8:
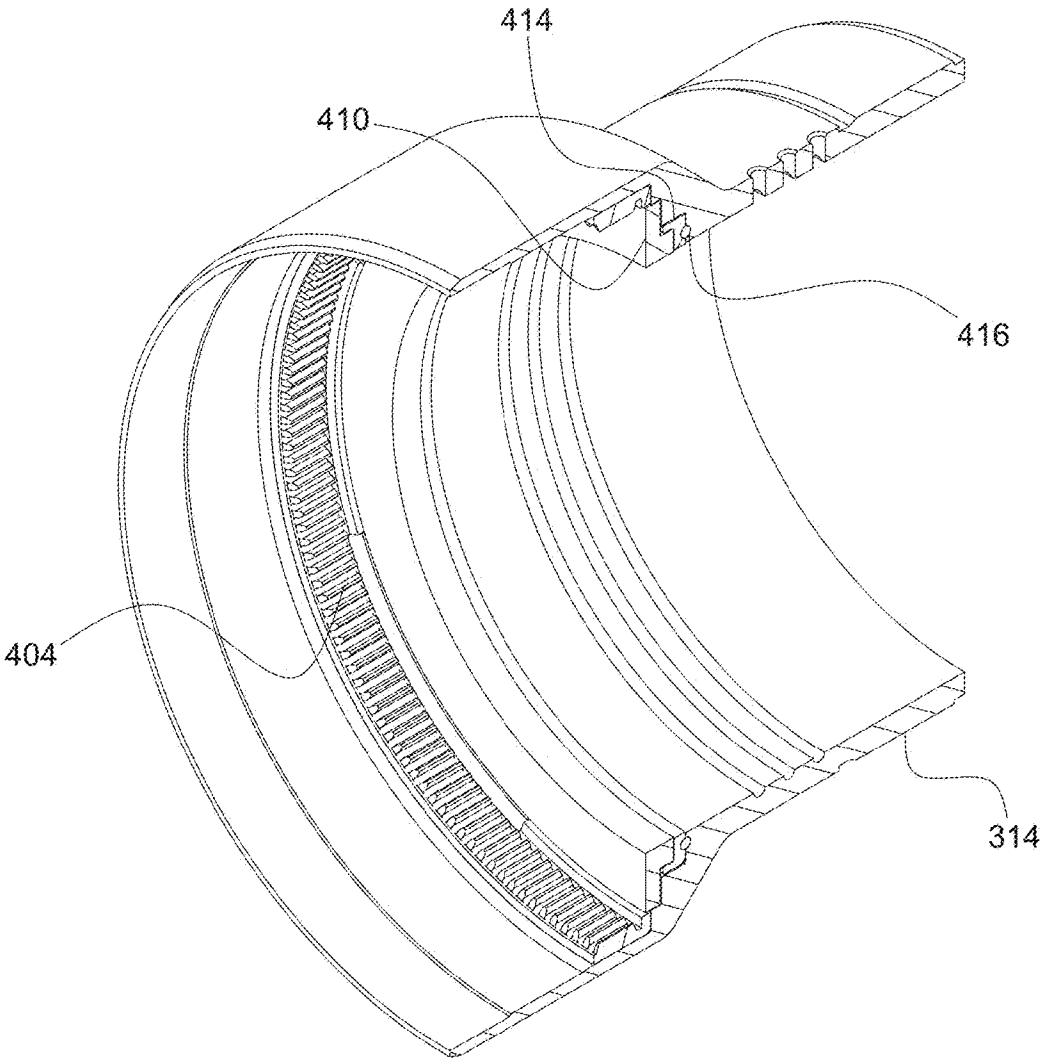
FIG. 8 is a perspective, cross-sectional view of the lower drive body and the lower drive body gear as part of the apparatus of FIG. 1, with a split retainer ring and a ring retainer shown for clarity.

FIGS. 5, 6, 7, 8, and 9 provide additional views to clarify the features of the drive assembly 210. FIGS. 5 and 6 depict a lower end 500 of the power assembly body 104, showing the plurality of fluid powered drive assemblies positioned within the power assembly body 104 and circumferentially spaced around the power assembly body 104. Although eight assemblies are shown (see FIG. 6), those skilled in the art will appreciate that additional or fewer assemblies may be provided without departing from the present invention. These views also depict a lower drive body gear lug 600 which extends radially inward and is configured to mate with a recess of the lower drive body 314. As previously discussed, as fluid flows through the fluid conduit(s) 304, gear rotation of the rotor drive gear 406 results which is transferred to the lower drive body gear 404, again, the lower drive body gear 404 is located radially outward from the rotor drive gear so as to create maximum leverage and resulting output torque of the lower drive body 314. In the embodiment shown, the lower drive body gear lug 600 transfers said torque from the rotor drive gear 406 to the lower drive body gear 404 and then to the lower drive body 314 (and ultimately to the cutting structure 108). FIGS. 7 and 8 show cut away views of the lower drive body gear 404 with the lower drive body gear lug 600. FIG. 8 shows the split retainer ring 410, ring retainer 414, and thrust bearing arrangement 416 for clarity in connection with the lower drive body 314.

Figure 9:
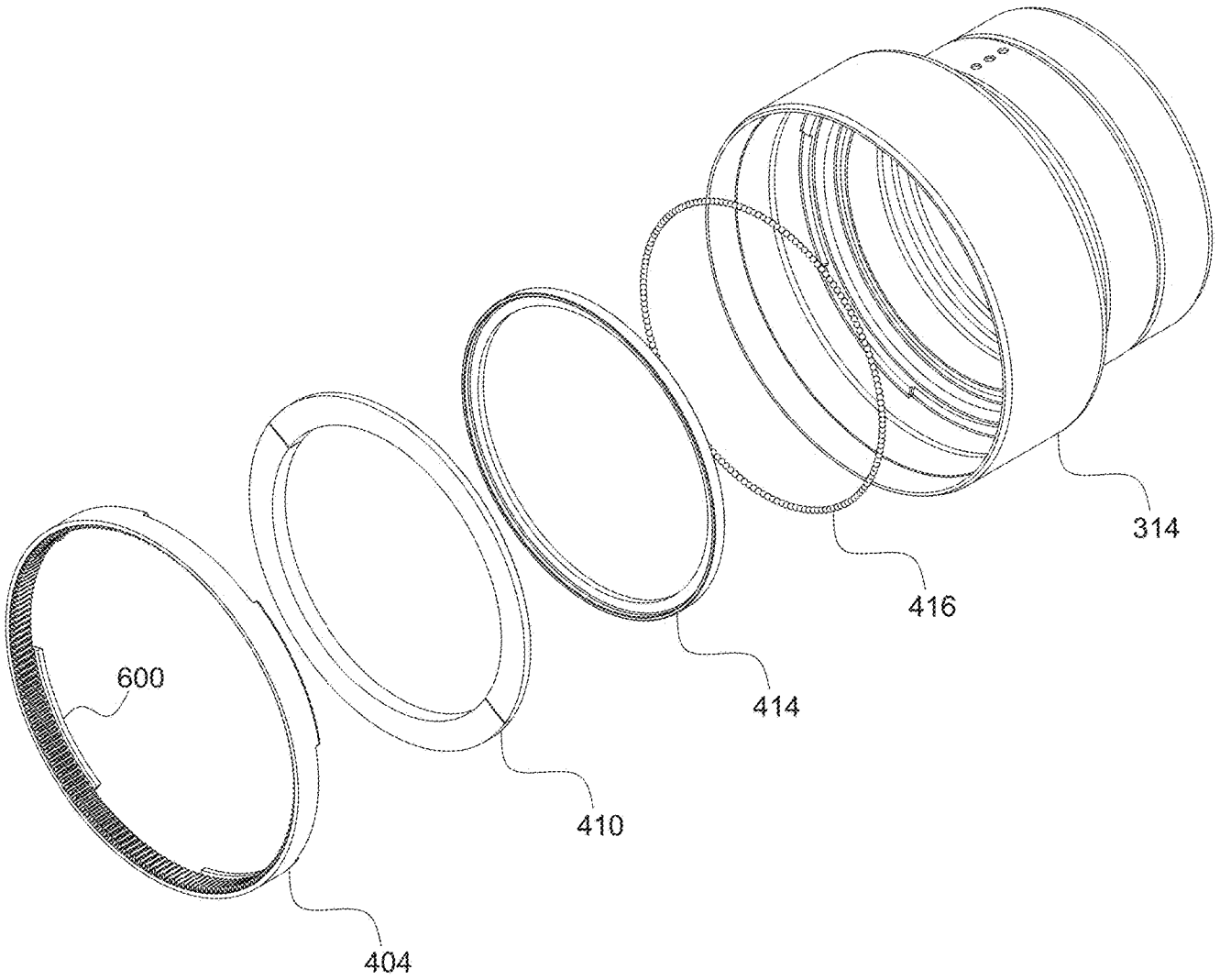
FIG. 9 is an exploded view of the lower drive body, the lower drive body gear, the split retainer ring, the ring retainer, and a thrust bearing arrangement as part of the apparatus of FIG. 1.

Turning to FIG. 9, an exploded view depicts the lower drive body 314, thrust bearing arrangement 416, split retainer ring 410, ring retainer 414, and lower drive body gear 404 having the lower drive body gear lug 600.

Figure 10:
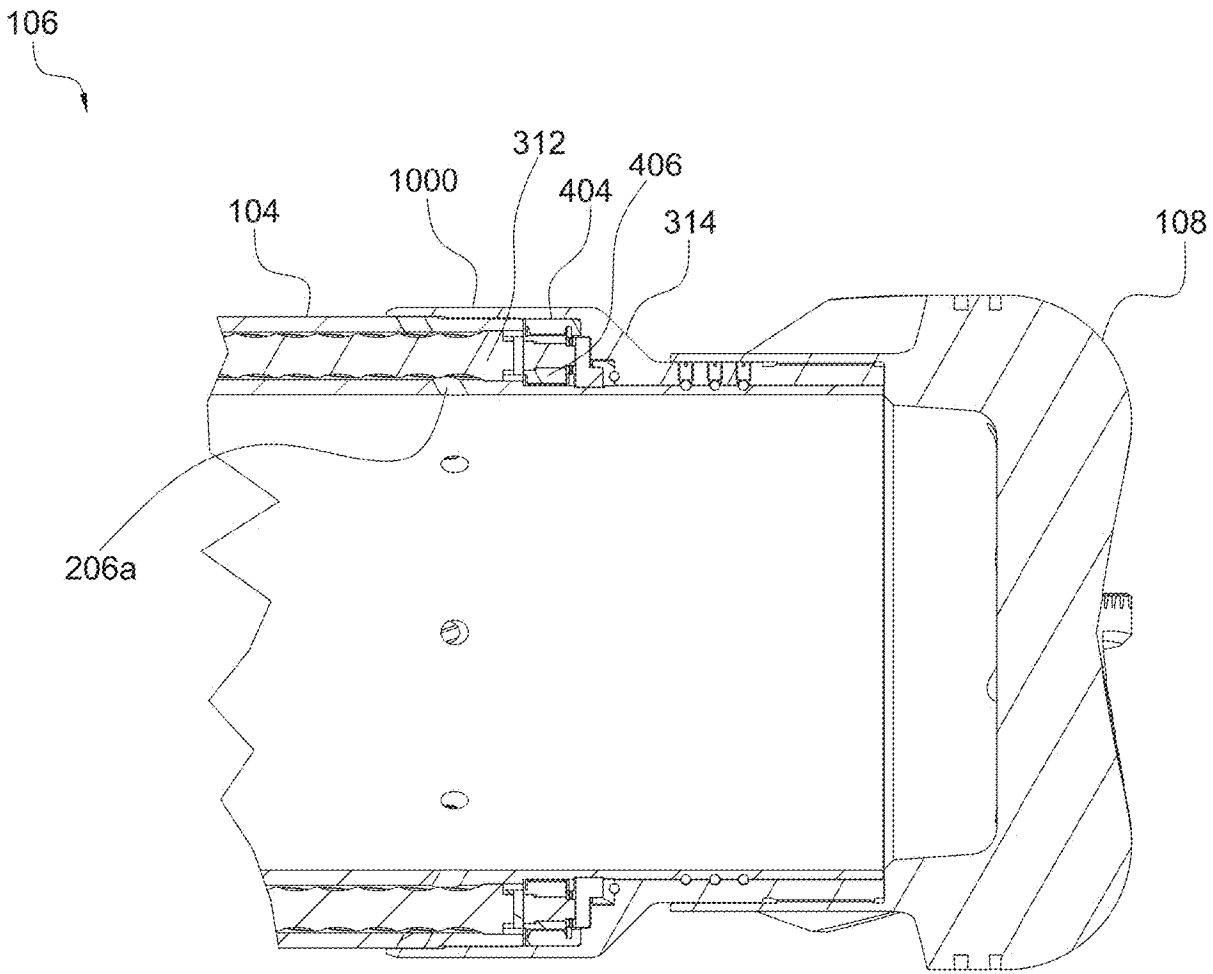
FIG. 10 is a detailed side view of a nose as part of the apparatus of FIG. 1.

Finally, turning to FIG. 10, a cross-section of the nose 106 is shown. As discussed above, the nose 106 includes the lower drive body 314 coupled to a cutting structure 108. This coupling may be completed with any means appropriate in the art, such as a threaded connection. Alternatively, these components may be integral with one another. A portion 1000 of the lower drive boy 314 creates a diameter larger than a diameter of the power assembly body 104, therefore fitting outside of a lower portion of the power assembly body 104, as shown. Accordingly, the lower drive body gear 404 fits inside of the portion 1000 while remaining radially outside of the rotor drive gear 406. Again, this feature provides maximum torque transfer to the lower drive body 314.

Those skilled in the art will readily appreciate at least the following benefits of the present invention:

The power assembly body 104 is fabricated from thick wall material to enable the fabrication of the stator profile 400 of each of the fluid powered drive assemblies within the fluid conduits 304. Fabricating the stator profile(s) 400 within the power assembly body 104 allows the total wall thickness to be less than when using conventional stator tubes that are installed into a body wall. The lesser wall thickness makes for a smaller total outer diameter of the apparatus 100, thereby improving the functionality and usefulness of the apparatus. Accordingly, in at least some embodiments, the stator profiles 400 are fabricated directly into the fluid conduits 304, however, in alternative embodiments, it is contemplated that the stator bodies forming the stator profiles can be inserted into the fluid conduits 304.

As discussed above, the rotor drive gears 406 are located radially inward from the driven gears (i.e. lower drive body gears 404), thereby providing greater leverage between the rotor drive gears 406 and the lower drive body gears 404 which results in an overall increase in output torque from the lower drive body 314.

The smooth outer surface 105 improves machinability during fabrication and improves the annular flow profile for annular hole cleaning during use.

Finally, the apparatus and method of fabrication of the present invention allows for the number of drive assemblies to be configured to match the application needed. Some or all of the fluid conduits can be used, or alternatively, rotors can be left out and the fluid conduits plugged should less torque and flow rate be needed.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

The invention claimed is:

1. A downhole apparatus with a plurality of fluid powered drive assemblies for driving a cutting structure, the apparatus comprising:

a power assembly body configured to couple to a casing string and to the cutting structure, the power assembly body forming a central flow bore and having an outer wall and an inner wall forming a plurality of fluid conduits disposed therebetween, each of the fluid conduits having a fluid inlet and a fluid outlet;

a lower drive body coupling the power assembly body to the cutting structure; and the plurality of fluid powered drive assemblies configured to transmit torque to the lower drive body, each of the plurality of fluid powered drive assemblies independently associated with each of the plurality of fluid conduits, each of the plurality of fluid powered drive assemblies having:

a stator profile forming a stator bore within the associated fluid conduit;

a rotor extending within the stator bore;

a rotor drive gear coupled to the rotor;

a rotor drive gear thrust bearing positioned at an end of the rotor, the rotor drive gear thrust bearing configured to support axial stress of the rotor while allowing rotary motion of the rotor;

a lower drive body gear configured to receive torque from the rotor drive gear;

a split retainer ring positioned at the end of the rotor and configured to retain the rotor drive gear thrust bearing; and a ring retainer positioned adjacent to the split retainer ring and configured to support the split retainer ring in a position;

wherein fluid flow through the associated fluid conduit generates power transmission to the rotor drive gear which then transfers torque to the lower drive body gear which then transfers torque to the lower drive body to operate the cutting structure.

2. The downhole apparatus of claim 1, wherein the lower drive body gear is positioned radially outward from the rotor drive gear.

3. The downhole apparatus of claim 1, wherein the lower drive body expends partially around the outer wall of the power assembly body.

4. The downhole apparatus of claim 1, wherein the split retainer ring extends into a recess of the power assembly body.

5. The downhole apparatus of claim 1, further comprising a thrust bearing arrangement positioned between the ring retainer and the lower drive body.

6. The downhole apparatus of claim 1, wherein the power assembly body comprises a uniform thickness between the inner wall and the outer wall.

7. The downhole apparatus of claim 1, wherein an outer surface of the outer wall is smooth.

8. The downhole apparatus of claim 1, further comprising a central flow barrier configured to block fluid flow through the central flow bore and direct fluid flow into the plurality of fluid conduits.

9. A method of fabricating a downhole apparatus with a plurality of fluid powered drive assemblies, the method comprising:

fabricating a power assembly body with an outer wall and an inner wall forming a plurality of fluid conduits disposed therebetween, the power assembly body fabricated with a central flow bore;

fabricating a lower drive body configured to couple the power assembly body with a cutting structure such that torque is transmitted to the cutting structure; and embedding the plurality of fluid powered drive assemblies into the plurality of fluid conduits, the plurality of fluid powered drive assemblies configured to transmit torque to the lower drive body, each of the plurality of fluid powered drive assemblies having:

a stator profile forming a stator bore within the associated fluid conduit;

a rotor extending within the stator bore;

a rotor drive gear coupled to the rotor;

a rotor drive gear thrust bearing positioned at an end of the rotor, the rotor drive gear thrust bearing configured to support axial stress of the rotor while allowing rotary motion of the rotor;

a lower drive body gear configured to receive torque from the rotor drive gear;

a split retainer ring positioned at the end of the rotor and configured to retain the rotor drive gear thrust bearing; and a ring retainer positioned adjacent to the split retainer ring and configured to support the split retainer ring in a position;

coupling the lower drive body to the power assembly body via the plurality of fluid powered drive assemblies;

wherein the downhole apparatus, once fabricated, is configured such that fluid flow through the associated fluid conduit generates power transmission to the rotor drive gear which then transfers torque to the lower drive body gear which then transfers torque to the lower drive body to operate the cutting structure.

10. The method of fabrication of claim 9, wherein the lower drive body gear is positioned radially outward from the rotor drive gear.

11. The method of fabrication of claim 9, wherein, once the downhole apparatus is fabricated, the lower drive body extends partially around the outer wall of the power assembly body.

12. The method of fabrication of claim 9, wherein the power assembly body is fabricated with a recess into which the split retainer ring is configured to extend.

13. The method of fabrication of claim 9, wherein each of the plurality of fluid powered drive assemblies further comprises a thrust bearing arrangement positioned between the ring retainer and the lower drive body.

14. The method of fabrication of claim 9, wherein the power assembly body is fabricated with a uniform thickness between the inner wall and the outer wall.

15. The method of fabrication of claim 9, wherein the outer wall of the power assembly body is fabricated with a smooth outer surface.

16. The method of fabrication of claim 9, further comprising installing a central flow barrier into the central flow bore, the central flow barrier configured to block fluid flow through the central flow bore and to direct fluid flow into the plurality of fluid conduits.

* * * * *